US008893501B2

(12) United States Patent
Antoniono et al.

(10) Patent No.: US 8,893,501 B2
(45) Date of Patent: Nov. 25, 2014

(54) COMBUSTOR CROSSFIRE TUBE

(75) Inventors: Carolyn Ashley Antoniono, Greenville, SC (US); Patrick Benedict Melton, Horse Shoe, NC (US)

(73) Assignee: General Eletric Company, Schenectady, NY (US)

( * ) Notice: Subject to any disclaimer, the term of this patent is extended or adjusted under 35 U.S.C. 154(b) by 912 days.

(21) Appl. No.: 13/072,820

(22) Filed: Mar. 28, 2011

(65) Prior Publication Data

US 2012/0247118 A1 Oct. 4, 2012

(51) Int. Cl.
*F02C 7/22* (2006.01)
*F23R 3/48* (2006.01)

(52) U.S. Cl.
CPC ..... *F23R 3/48* (2013.01)
USPC ..... 60/752; 60/754; 60/39.37; 60/797; 60/737

(58) Field of Classification Search
CPC ..... F23R 3/46; F23R 3/48; F23R 2900/03041
USPC ..... 60/752, 754, 776, 39.286, 39.821, 60/39.37, 797, 737
See application file for complete search history.

(56) References Cited

U.S. PATENT DOCUMENTS

| | | | | |
|---|---|---|---|---|
| 3,811,274 | A * | 5/1974 | Calderon | 60/800 |
| 3,991,560 | A * | 11/1976 | DeCorso et al. | 60/800 |
| 5,001,896 | A * | 3/1991 | Hilt et al. | 60/800 |
| 5,361,577 | A * | 11/1994 | Cromer | 60/800 |
| 5,896,742 | A | 4/1999 | Black et al. | |
| 6,220,015 | B1 * | 4/2001 | Mina | 60/39.37 |
| 6,334,294 | B1 | 1/2002 | Belsom et al. | |
| 6,606,865 | B2 | 8/2003 | Tilson et al. | |
| 6,705,088 | B2 | 3/2004 | Martling et al. | |
| 6,912,838 | B2 * | 7/2005 | Sileo et al. | 60/39.37 |
| 2,983,342 | A1 | 1/2011 | Toronto et al. | |
| 2007/0151260 | A1 | 7/2007 | Nichols et al. | |
| 2009/0139241 | A1 * | 6/2009 | Hirata et al. | 60/746 |
| 2010/0300107 | A1 | 12/2010 | Barton et al. | |

* cited by examiner

*Primary Examiner* — Phutthiwat Wongwian
*Assistant Examiner* — Steven Sutherland
(74) *Attorney, Agent, or Firm* — Sutherland Asbill & Brennan LLP

(57) ABSTRACT

The present application and the resultant patent provide a combustor for mixing a flow of air and a flow of fuel. The combustor may include an air path for the flow of air, a number of fuel injectors positioned in the air path for the flow of fuel, and a crossfire tube positioned within the air path upstream of the fuel injectors. The crossfire tube may include a number of purge holes positioned on a downstream side thereof to reduce a wake in the flow of air caused by the crossfire tube in the air path.

20 Claims, 4 Drawing Sheets

COMBUSTOR CROSSFIRE TUBE

TECHNICAL FIELD

The present application relates generally to gas turbine engines and more particularly relates to gas turbine engine combustors with crossfire tubes having purge holes positioned therein to limit a wake or other types of flow disturbances downstream thereof.

BACKGROUND OF THE INVENTION

In a conventional gas turbine engine and the like, operational efficiency generally increases as the temperature of the combustion stream increases. Higher combustion stream temperatures, however, may result in the production of higher levels of nitrogen oxides ("$NO_x$") and other types of undesirable emissions. Such emissions may be subject to both federal and state regulation in the United States and also may be subject to similar regulations abroad. A balancing act thus exists between operating the gas turbine engine within an efficient temperature range while also ensuring that the output of nitrogen oxides and other types of regulated emissions remain below the mandated levels.

Several types of known gas turbine engine designs, such as those using Dry Low $NO_x$ ("DLN") combustors, generally premix the fuel flows and the air flows upstream of a reaction or a combustion zone so as to reduce nitrogen oxide emissions via a number of premixing fuel nozzles. Such premixing tends to reduce overall combustion temperatures and, hence, nitrogen oxide emissions and the like.

Premixing, however, may present several operational issues such as flame holding, flashback, auto-ignition, and the like. These issues may be a particular concern with the use of highly reactive fuels. For example, given an ignition source, a flame may be present in the head-end of a combustor upstream of the fuel nozzles with any significant fraction of hydrogen or other types of fuels. Any type of fuel rich pocket thus may sustain a flame and cause damage to the combustor.

Other premixing issues may be due to irregularities in the fuel flows and the air flows. For example, there are several flow obstructions that may disrupt the flow through an incoming pathway between a flow sleeve and a liner. With a combustor having fuel injector vanes that inject fuel into the airflow upstream of the head-end, these flow disturbances may create flow recirculation zones on the trailing edge of the vanes. These recirculation zones may lead to stable pockets of ignitable fuel-air mixtures that can in turn lead to flame holding or other types of combustion events given an ignition source.

One example of a flow obstruction is a crossfire tube. Generally described, a crossfire tube may be used to connect adjacent combustor cans. The crossfire tubes provide for the ignition of fuel in one combustion can from the ignited fuel in an adjacent combustion can. The crossfire tubes thus eliminate the need for a separate igniter in each can. The crossfire tubes also serve to equalize the pressure between adjacent combustor cans. The crossfire tubes generally are positioned upstream of the premixing fuel injectors and pass through the incoming flow path between the liner and the flow sleeve. As such, the crossfire tubes may cause a wake in the flow path that may envelop one or more of the premixing fuel injectors. As described above, such a wake may cause recirculation zones and, hence, fuel holding and other types of flow disturbances.

There is therefore a desire for an improved combustor design. Such an improved design should accommodate flow disturbances caused by crossfire tubes and the like so as to avoid flame holding, flashback, auto ignition, and other types of flow disturbances. Moreover, such an improvement should provide increased efficiency and extended component lifetime.

SUMMARY OF THE INVENTION

The present application and the resultant patent thus provide a combustor for mixing a flow of air and a flow of fuel. The combustor may include an air path for the flow of air, a number of fuel injectors positioned in the air path for the flow of fuel, and a crossfire tube positioned within the air path upstream of the fuel injectors. The crossfire tube may include a number of purge holes positioned on a downstream side thereof so as to reduce a wake in the flow of air caused by the crossfire tube in the air path.

The present application and the resultant patent further provide a method of operating a pre-nozzle fuel injection system. The method may include the steps of flowing air through an air path, flowing fuel through a number of fuel injectors, creating a wake in the flow of air upstream of the fuel injectors with a crossfire tube, flowing purge gas through a number of purge holes in the crossfire tube, creating an area of boundary layer suction about the crossfire tube, and eliminating or reducing the wake upstream of the fuel injectors by the area of boundary layer suction.

The present application and the resultant patent further provide a combustor for mixing a flow of air and a flow of fuel. The combustor may include an air path for the flow of air, a number of fuel injectors positioned in the air path for the flow of fuel, and a crossfire tube positioned within the air path upstream of the fuel injectors. The crossfire tube may include one or more purge holes positioned on a downstream side thereof with a flow of purge gas flowing therethrough so as to create an area of boundary layer suction downstream of the crossfire tube.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
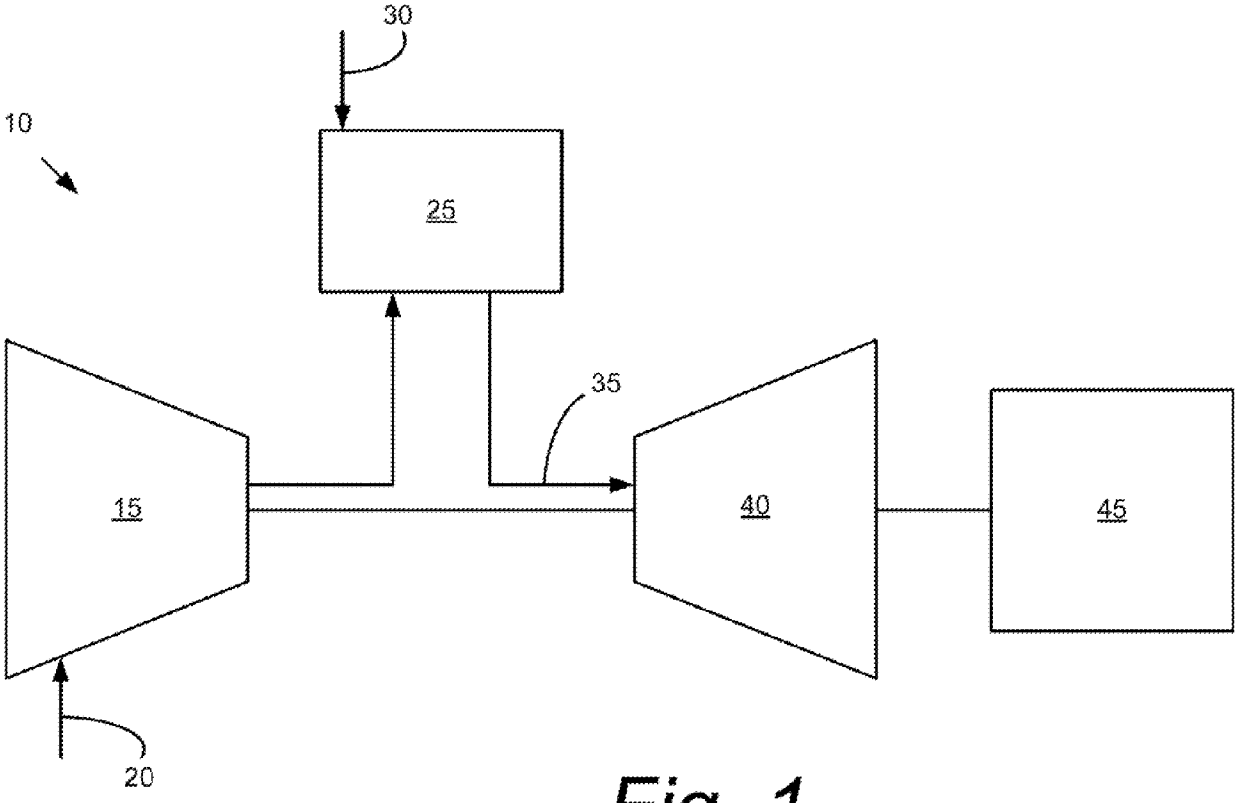
FIG. 1 is a schematic view of a known gas turbine engine as may be used herein.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor delivers the compressed flow of air 20 to a combustor 25. The combustor 25 mixes the compressed flow of air 20 with a compressed flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 and an external load 45 such as an electrical generator and the like.

The gas turbine engine 10 may use natural gas, various types of syngas, and/or other types of fuels. The gas turbine engine 10 may be anyone of a number of different gas turbine engines offered by General Electric Company of Schenectady, N.Y. and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
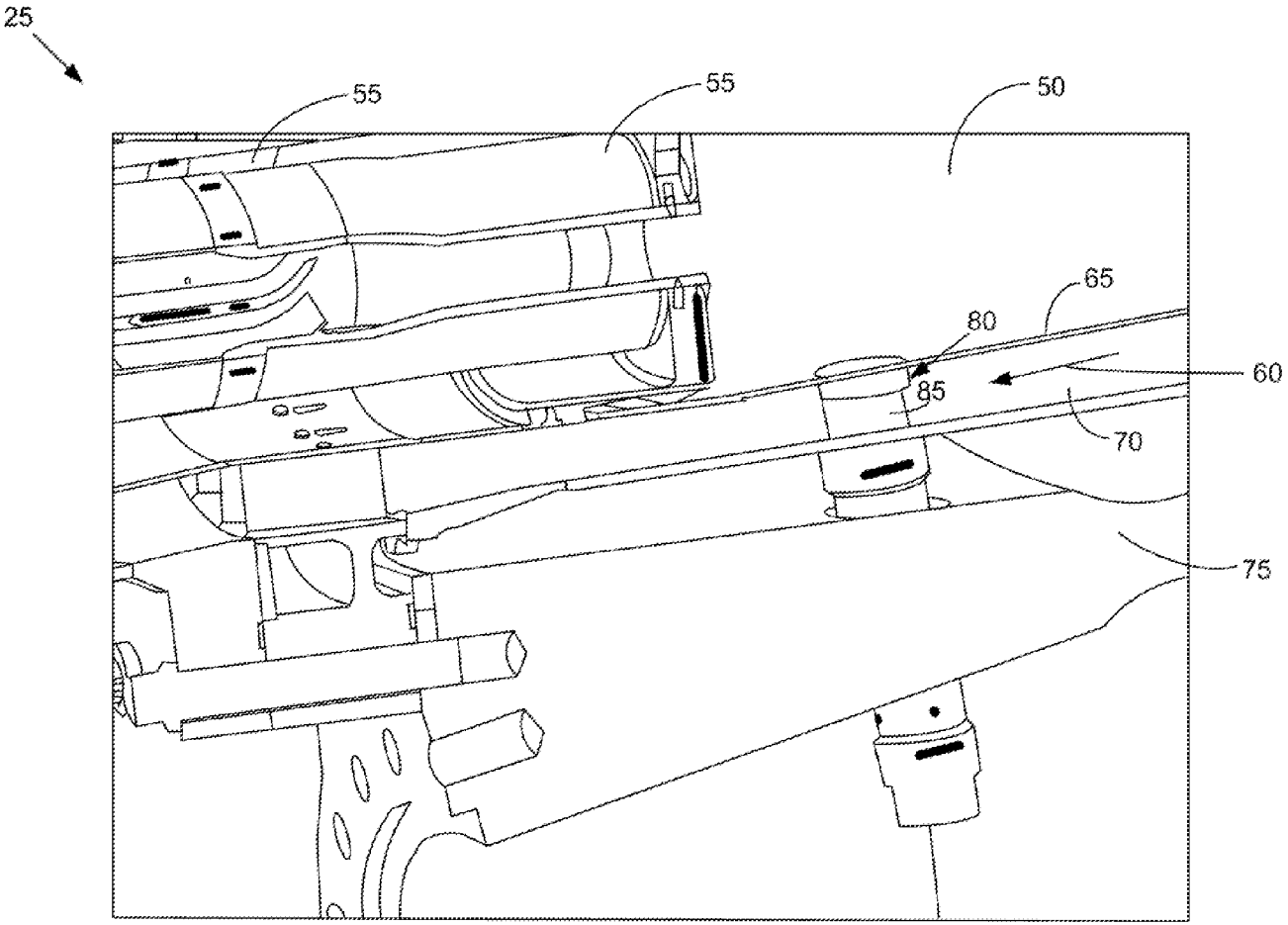
FIG. 2 is a side cross-sectional view of a known combustor.

FIG. 2 shows a simplified example of portions of a known combustor 25 that may be used with the gas turbine engine 10. Generally described, the combustor 25 may include a combustion chamber 50 with a number of fuel nozzles 55 positioned therein. The flow of air 20 may enter the combustor 25 from the compressor 15 via an incoming air path 60. The incoming air path 60 may be defined between a liner 65 of the combustion chamber 50 and a flow sleeve 70. A casing 75 may surround the flow sleeve 70. The flow of air 20 may travel along the incoming air path 60 and then reverse direction about the fuel nozzles 55. The flow of air 20 and the flow of fuel 30 may be ignited downstream of the fuel nozzles 55 within the combustion chamber 50 such that the flow of the combustion gases 35 may be directed towards the turbine 40. Other configurations and other components also may be used herein.

As described above, a number of flow obstructions 80 also may be positioned within the incoming air path 60. These flow obstructions 80 may be structures such as a number of crossfire tubes 85. The crossfire tubes 85 may extend between the casing 75 and the flow sleeve 70 and extend through the flow sleeve 70 towards the liner 65. Other types of obstructions 80 may include liner penetrations, liner stops, and the like. These flow obstructions 80 may create a low velocity wake or a low or negative velocity recirculation zone. The wake or the recirculation zone may envelop one or more of the fuel injectors and/or create other types of local flow disturbances. A flow of the fuel 30 within the incoming air path 60 thus may be pulled upstream within the wake or recirculation zone. Although these flow obstructions 80 may cause these flow disturbances, the structures such as the crossfire tubes 85 are otherwise required for efficient combustor operation.

Figure 3:
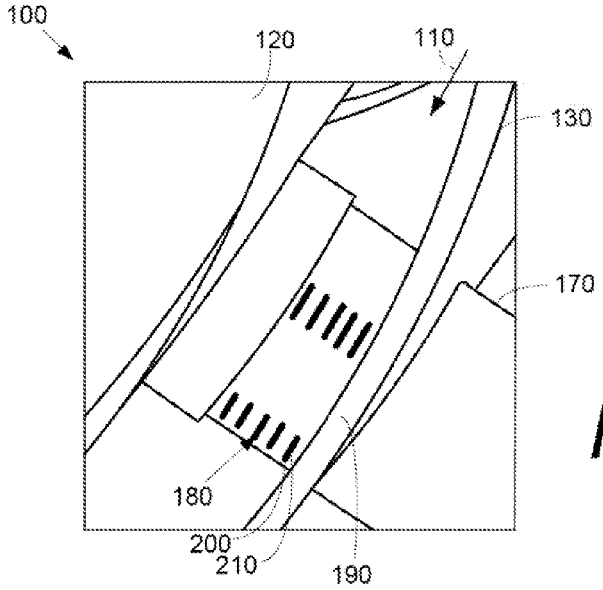
FIG. 3 is a partial perspective view of a combustor with a crossfire tube as may be described herein.

FIG. 3 shows portions of a combustor 100 as may be described herein. Specifically, an air path 110 may be configured between a liner 120 and a flow sleeve 130 for the flow of air 20 therethrough. The air path 110 also may be configured between other structures. The combustor 100 may include a number of fuel pegs or fuel injectors 140 positioned in the air path 110. The fuel injectors 140 likewise may have an aerodynamic airfoil or streamlined shape to optimize flame holding resistance. Other shapes may be used herein. Any number of the fuel injectors 140 may be used in any size or position. The fuel injectors 140 each may have a number of injector holes therein on one or both sides in any size or position. Other configurations and other components may be used herein.

The combustor 100 also may include one or more crossfire tubes 170. As described above, the crossfire tube 170 may extend through the liner 120 and the flow sleeve 130 and may be positioned within the air path 110. In addition to connecting adjacent combustors 100, a secondary function of the crossfire tube 170 is to provide purge air. Purge air may be fed to the crossfire tubes 170 at approximately the compressor discharge pressure so as to prevent unwanted migration of unburned fuel between adjacent combustors 100. As such, each of the crossfire tubes 170 has a number of purge holes 180. The purge holes 180 may have any desired size or shape and any number may be used. Although a number of purge holes 180 are shown, a single purge hole 180 may be used herein. The purge holes 180 may be continuous, interrupted, or combinations thereof.

Figure 4:
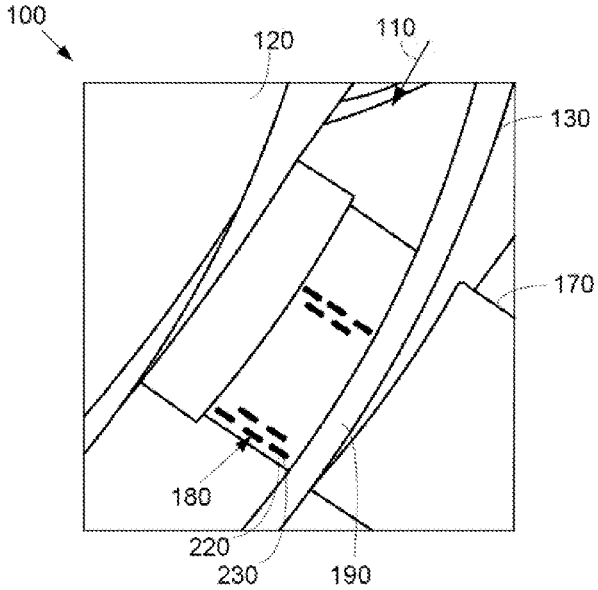
FIG. 4 is an alternative embodiment of a combustor with a crossfire tube as may be described herein.
Figure 5:
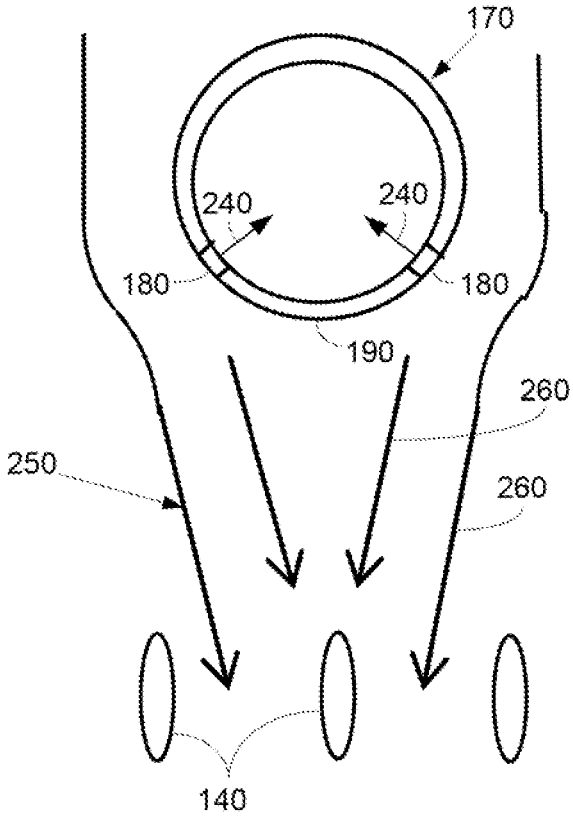
FIG. 5 is a schematic view of the operation of the crossfire tubes of FIGS. 3 and 4.

In this example, the purge holes 180 may be positioned about a downstream side 190 of the crossfire tube 170. FIG. 3 shows an example of the purge holes 180 in a number of columns 200 extending in a circumferential direction. FIG. 4 shows an example of the purge holes 180 positioned in a grouping 200 extending in an axial direction 230. Any number of columns 200 or groupings 220 may be used herein in any configuration or orientation with any number of purge holes 180 in each and/or combinations thereof.

In use, a flow of the purge gas 240 enters the purge holes 180 at about the compressor discharge pressure. The positioning of the purge holes 180 on the downstream side 190 of the crossfire tube 170 thus creates an area of boundary layer suction 250 given a pressure drop about the flow sleeve 130 (in terms of a percentage of compressor discharge pressure. This area of boundary layer suction 250 causes a wake 260 created by the flow of air 20 passing the crossfire tube 170 to be reduced in size in both width and length. As such, the wake 260 may be eliminated or reduced before reaching the fuel injectors 140.

The reduction or elimination of the wake 260 thus may reduce downstream flow disturbances and the potential for recirculation zones. The elimination of such recirculation zones also should reduce the possibility of flame holding. The placement and sizing of the purge holes 180 may be optimized so as to maximize the area of the boundary layer suction 250 so as to reduce or eliminate the wake 260. Reducing the wake 260 also should enable early fuel introduction so as to reduce casing corrosion and the like. Moreover, the downstream positioning of the purge holes 180 should reduce the pressure drop thereacross. The placement and definition of the purge holes 180 also may increase the heat transfer across the crossfire tubes 170 so as to provide an increased lifetime.

It should be apparent that the foregoing relates only to certain embodiments of the present application and resultant patent. Numerous changes and modifications may be made herein by one of ordinary skill in the art without departing from the general spirit and scope of the invention as defined by the following claims and the equivalents thereof.

We claim:

1. A combustor for mixing a flow of air and a flow of fuel therein, the combustor comprising:

a liner defining a combustion chamber therein;

a flow sleeve positioned around the liner;

an air path for directing the flow of air, the air path defined between the liner and the flow sleeve;

a plurality of fuel injectors for directing the flow of fuel, the fuel injectors positioned within the air path; and a crossfire tube comprising an end portion positioned within the air path upstream of the fuel injectors;

wherein the end portion of the crossfire tube comprises a solid wall extending along an upstream side thereof and a plurality of purge holes defined in a downstream side thereof, the purge holes configured to reduce a wake in the flow of air caused by the end portion of the crossfire tube in the air path.

2. The combustor of claim 1, wherein the air path extends circumferentially between the liner and the flow sleeve.

3. The combustor of claim 1, wherein the purge holes are arranged in a plurality of columns, each column extending axially along the end portion.

4. The combustor of claim 1, wherein the purge holes each have an elongated shape extending circumferentially along the end portion.

5. The combustor of claim 1, wherein the purge holes are arranged in a plurality of groupings, each grouping extending axially along the end portion.

6. The combustor of claim 1, wherein purge holes each have an elongated shape extending axially along the end portion.

7. The combustor of claim 1, wherein the purge holes are configured to allow a flow of purge gas to flow therethrough and into the crossfire tube.

8. The combustor of claim 7, wherein the wherein the purge holes are configured to create an area of boundary layer suction downstream of the end portion of the crossfire tube.

9. The combustor of claim 1, wherein the purge holes are configured to eliminate or reduce the wake in the flow of air upstream of the fuel injectors.

10. The combustor of claim 1, wherein the crossfire tube extends between the combustion chamber and a second combustion chamber of a second combustor.

11. The combustor of claim 1, further comprising a plurality of fuel nozzles positioned downstream of the fuel injectors.

12. The combustor of claim 11, wherein the combustion zone is positioned downstream of the fuel nozzles.

13. A method of operating a pre-nozzle fuel injection system, the method comprising:

flowing air through an air path defined between a liner and a flow sleeve of a combustor;

flowing fuel through a plurality of fuel injectors positioned within the air path;

creating a wake in the flow of air upstream of the fuel injectors with an end portion of a crossfire tube positioned within the air path, the end portion comprising a solid wall extending along an upstream side thereof and a plurality of purge holes defined in a downstream side thereof;

flowing purge gas through the purge holes and into the crossfire tube;

creating an area of boundary layer suction downstream of the end portion of the crossfire tube; and eliminating or reducing the wake upstream of the fuel injectors via the area of boundary layer suction.

14. The method of claim 13, further comprising the step of reducing a recirculation zone about the fuel injectors.

15. The method of claim 13, further comprising the step of reducing flame holding about the fuel injectors.

16. A combustor for mixing a flow of air and a flow of fuel therein, the combustor comprising:

a liner defining a combustion chamber therein;

a flow sleeve positioned around the liner;

an air path for directing the flow of air, the air path defined between the liner and the flow sleeve;

a plurality of fuel injectors for directing the flow of fuel, the fuel injectors positioned within the air path; and a crossfire tube comprising an end portion positioned within the air path upstream of the fuel injectors;

wherein the end portion of the crossfire tube comprises a solid wall extending along an upstream side thereof and one or more purge holes defined in a downstream side thereof, the one or more purge holes configured to allow a flow of purge gas to flow therethrough and into the crossfire tube to create an area of boundary layer suction downstream of the end portion of the crossfire tube.

17. The combustor of claim 16, wherein the one or more purge holes comprises a plurality of purge holes arranged in a plurality of columns, each column extending axially along the end portion.

18. The combustor of claim 16, wherein the one or more purge holes each have an elongated shape extending circumferentially along the end portion.

19. The combustor of claim 16, wherein the one or more purge holes comprises a plurality of purge holes arranged in a plurality of groupings, each grouping extending axially along the end portion.

20. The combustor of claim 16, wherein the one or more purge holes each have an elongated shape extending axially along the end portion.

* * * * *

UNITED STATES PATENT AND TRADEMARK OFFICE

CERTIFICATE OF CORRECTION

PATENT NO. : 8,893,501 B2
APPLICATION NO. : 13/072820
DATED : November 25, 2014
INVENTOR(S) : Carolyn Ashley Antoniono et al.

It is certified that error appears in the above-identified patent and that said Letters Patent is hereby corrected as shown below:

On the title page item (73), change "General Eletric Company" to -- General Electric Company --.

In the Claims,

In Column 5, Line 12, change "wherein purge holes" to -- wherein the purge holes --.

In Column 5, Line 18, change "wherein the wherein the" to -- wherein the --.

Signed and Sealed this
Tenth Day of March, 2015

Michelle K. Lee

Michelle K. Lee
*Deputy Director of the United States Patent and Trademark Office*